US005706769A

United States Patent [19]

Shimizu

[11] Patent Number: 5,706,769

[45] Date of Patent: Jan. 13, 1998

[54] OHC ENGINE

[75] Inventor: Yasuhiro Shimizu, Wako, Japan

[73] Assignee: Honda Giken Kogyo Kabushiki Kaisha, Tokyo, Japan

[21] Appl. No.: 524,456

[22] Filed: Sep. 6, 1995

[30] Foreign Application Priority Data

Sep. 7, 1994 [JP] Japan ..... 6-214051

[51] Int. Cl.[6] ..... F01L 1/12; F01L 1/26

[52] U.S. Cl. ..... 123/90.23; 123/90.27; 123/195 HC; 123/572

[58] Field of Search ..... 123/90.22, 90.23, 123/90.27, 90.31, 90.39, 90.6, 195 HC, 196 W, 572

[56] References Cited

U.S. PATENT DOCUMENTS 4,714,059 12/1987 Masuda et al. ..... 123/90.23
4,984,539 1/1991 Shinoda et al. ..... 123/90.27
5,143,033 9/1992 Catterson et al. ..... 123/90.27
5,513,606 5/1996 Shibata ..... 123/195 HC

*Primary Examiner*—Weilun Lo
*Attorney, Agent, or Firm*—Nikaido, Marmelstein, Murray & Oram, LLP

[57] ABSTRACT

A single overhead cam (OHC) engine is provided in which intake and exhaust valves and intake and exhaust cam followers are disposed on opposite sides of a single valve operating cam which is disposed in a cylinder head. The intake and exhaust valves are parallel to each other and perpendicular to a crankshaft axis. The intake and exhaust cam followers are formed in a bifurcated configuration. One arm portions of the intake and exhaust cam followers extend inwardly towards each other, and contact the intake and exhaust valves, and other arm portions of the intake and exhaust cam followers also extend inwardly towards each other, and contact a cam face of the valve operating cam below a center C of rotation of the valve operating cam. With this arrangement, it is possible to reduce, in both size and cost, the head of the engine body in an OHC engine.

6 Claims, 5 Drawing Sheets

OHC ENGINE

BACKGROUND OF THE INVENTION

1. Field of the Invention

The present invention relates to an improvement in an overhead cam (OHC) engine, and particularly, to a novel OHC engine which can be produced inexpensively and in which the engine, particularly the engine head, can be reduced in size.

1. Description of the Prior Art

An OHC engine is conventionally well known as seen, for example, in a section of "Jidousha Kougaku Zensho" Chapter 4, Gasoline Engine, issued by Sankaidou, and Japanese Utility Model Application Laid-Open No. 13820/75, which includes a cam shaft disposed on a cylinder head, intake and exhaust cam followers which contact a cam face of a single valve operating cam provided on the cam shaft, so that intake and exhaust valves are driven by the cam followers.

Such an OHC engine has the advantage that a combustion engine can be made into any shape in a compact manner, an exhaust port can be designed with a high degree of freedom and further, the engine can be designed for high performance. However, the OHC engine has a problem in that the valve operating system including the valve operating cam is disposed above the combustion chamber, and the intake and exhaust valves are disposed in a V-shaped arrangement. This increases the size of the head of the engine body, and increases the cost.

SUMMARY OF THE INVENTION

The present invention has been accomplished with such circumstance in view, and it is an object of the present invention to provide a novel OHC engine, wherein a reduction in size of the engine head is achieved, and the above problem can be solved.

To achieve the above object, according to a first feature of the present invention, there is provided an OHC engine comprising a cam shaft disposed on a cylinder head and having a single valve operating cam, the valve operating cam being rotated by a crankshaft through a timing transmitting mechanism. Intake and exhaust valves contact the cam face of the valve operating cam through intake and exhaust cam followers, whereby both of the intake and exhaust valves can be driven by the single valve operating cam. The cam shaft is disposed on a cylinder axis, and the intake and exhaust valves are symmetrically disposed on opposite sides of the cam shaft, respectively. The intake and exhaust cam followers are also symmetrically disposed on opposite sides of the cam shaft, respectively. The intake and exhaust valves are substantially parallel to each other and substantially perpendicular to a crankshaft axis, and the intake and exhaust cam followers are formed into a bifurcated configuration and swingably pivoted at their intermediate portions on the cylinder head. The intake and exhaust cam followers have two arm portions, respectively, one arm portion of the intake and exhaust cam followers extending in directions to approach each other and contact the intake and exhaust valves, and the other arm portion of the intake and exhaust cam followers extending in directions to approach each other, the other arm portions having slip faces provided at their tip ends which contact a cam face of the valve operating cam below the center of rotation of the valve operating cam.

According to the first feature of the invention, the center of the cam shaft is disposed on the cylinder axis, and the intake and exhaust valves of the intake and exhaust cam followers are symmetrically disposed. The intake and exhaust valves are substantially parallel to each other and perpendicular to the crankshaft axis, and the intake and exhaust cam followers are formed into the bifurcated configuration and swingably pivoted at their intermediate portions on the cylinder head. The one arm portions of the intake and exhaust cam followers extend in directions to approach each other and contact at their front ends, the intake and exhaust valves, and the other arm portions of the intake and exhaust cam followers also extend in directions to approach each other and have slip faces provided at their tip ends which contact the cam face of the valve operating cam below the center of rotation of the valve operating cam. Thus, the intake and exhaust valves and the intake and exhaust cam followers can be collectively positioned in a compact manner to surround the single valve operating cam, with no portions projecting outwardly, and the valve operating cam is disposed on the cylinder head. Therefore, in the OHC engine of such construction, the width of the engine head, i.e., of the cylinder head, particularly in a direction perpendicular to the crankshaft axis can be reduced. As a result, the compactness of the engine can be achieved, and the processing and assembling of the mounting portions of the intake and exhaust valves to the cylinder head are facilitated. This makes it possible to provide a reduction in cost of the engine itself in conjunction with the compactness.

According to a second feature of the invention, the single valve operating cam is disposed in a clearance defined between the intake and exhaust valves and a timing follower pulley of the timing transmitting mechanism. Since the single valve operating cam is disposed in the clearance between the intake and exhaust valves and the timing follower pulley of the timing transmitting mechanism, the width of the engine head, particularly in the axial direction of the crankshaft can be reduced, in addition to the reduction in width of the engine head in the direction perpendicular to the crankshaft axis. As a result, it is possible to achieve the further compactness of the engine.

The above and other objects, features and advantages of the invention will become apparent from the following description of preferred embodiments taken in conjunction with the accompanying drawings.

DETAILED DESCRIPTION OF THE PREFERRED EMBODIMENTS

Figure 1:
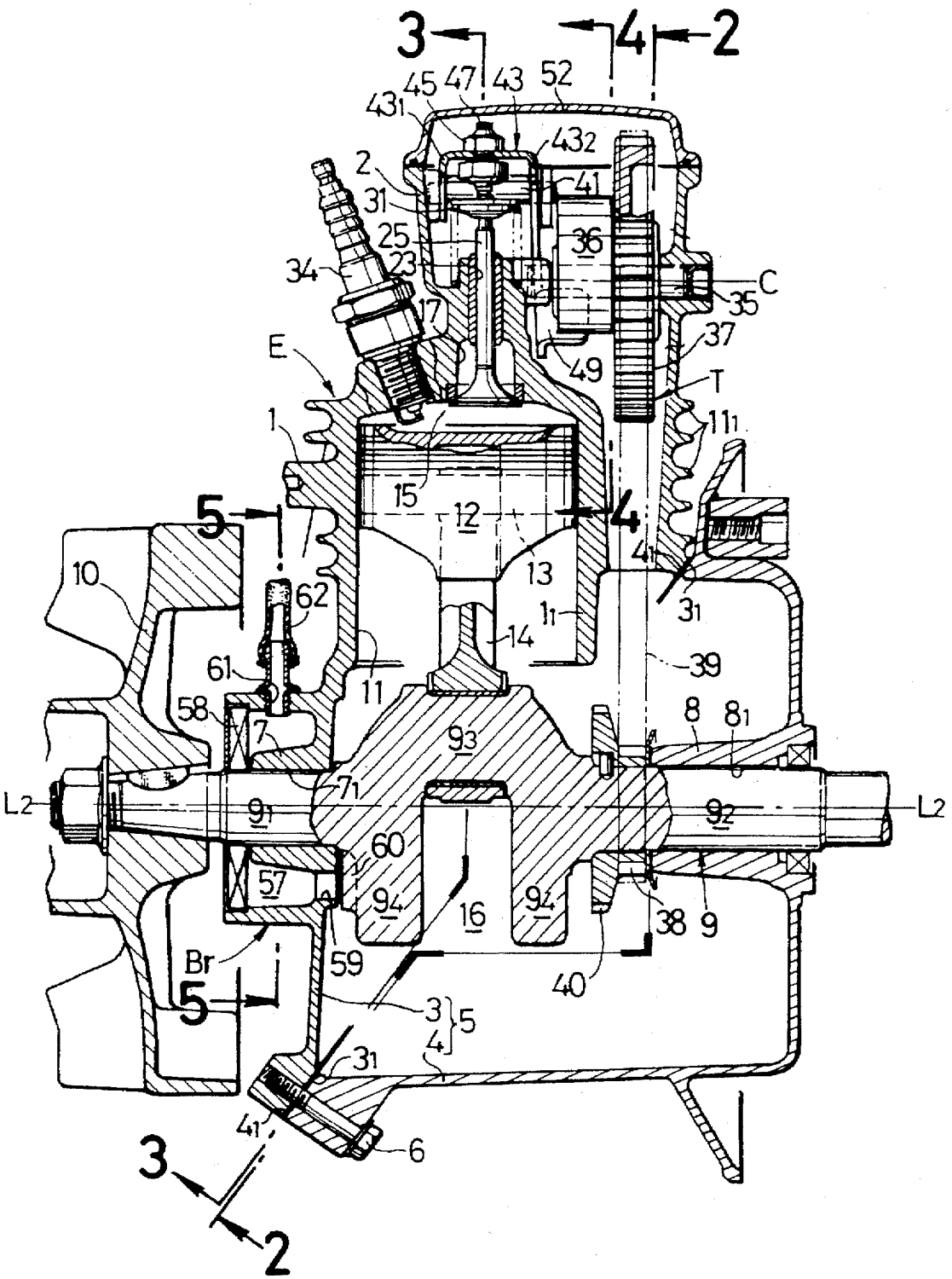
FIG. 1 is a sectional view of an OHC engine in a vertical section extending along a crank axis, taken along a line 1—1 in FIG. 2.

The present invention will now be described by way of a preferred embodiment with reference to the accompanying drawings.

The OHC engine is of an air-cooled single-cylinder type engine. An engine body E comprises a main portion of the OHC engine made of a light alloy such as an iron alloy or an aluminum alloy, and is formed by integrally molding a cylinder block 1, a cylinder head 2 and a crankcase half 3. Another crankcase half 4 separately formed from the same material as the crankcase half 3 is coupled to the crankcase half 3 to form a crankcase 5. More specifically, bonding faces $3_1$ and $4_1$ are formed respectively on the one crankcase half 3 and the other crankcase half 4 are obliquely cut to traverse a cylinder axis $L_1$—$L_1$ and a crankshaft axis $L_2$—$L_2$. The crankcase 5 is formed by mating the bonding faces $3_1$ and $4_1$ to each other and coupling them by a plurality of bolts 6. Journals $9_1$ and $9_2$ Of a crankshaft 9 are rotatably carried directly on a bearing bores $7_1$ and $8_1$ of crank bearings 7 and 8 formed in crankcase halves 3 and 4, respectively. A flywheel 10 is secured in a conventional manner to one end of the crankshaft 9.

Of course, the crankshaft may be carried on the crank bearings 7 and 8 with a face bearing or a rolling bearing interposed therebetween.

A plurality of cooling fins $11_1$ are projectingly, integrally provided around an outer periphery of a cylinder barrel portion $1_1$ of the cylinder 5 block 1. A piston 12 is slidably received in a cylinder bore 11 within the cylinder barrel $1_1$. A combustion chamber 15 is defined by a top face of the piston 12 and the wall surface of the cylinder head 2 opposed to the top face. The smaller end of a connecting rod 14 is rotatably connected to the piston 12 through a piston pin 13, and a crank-pin $9_3$ of the crankshaft 9 is rotatably connected to the larger end of the connecting rod 14.

Figure 3:
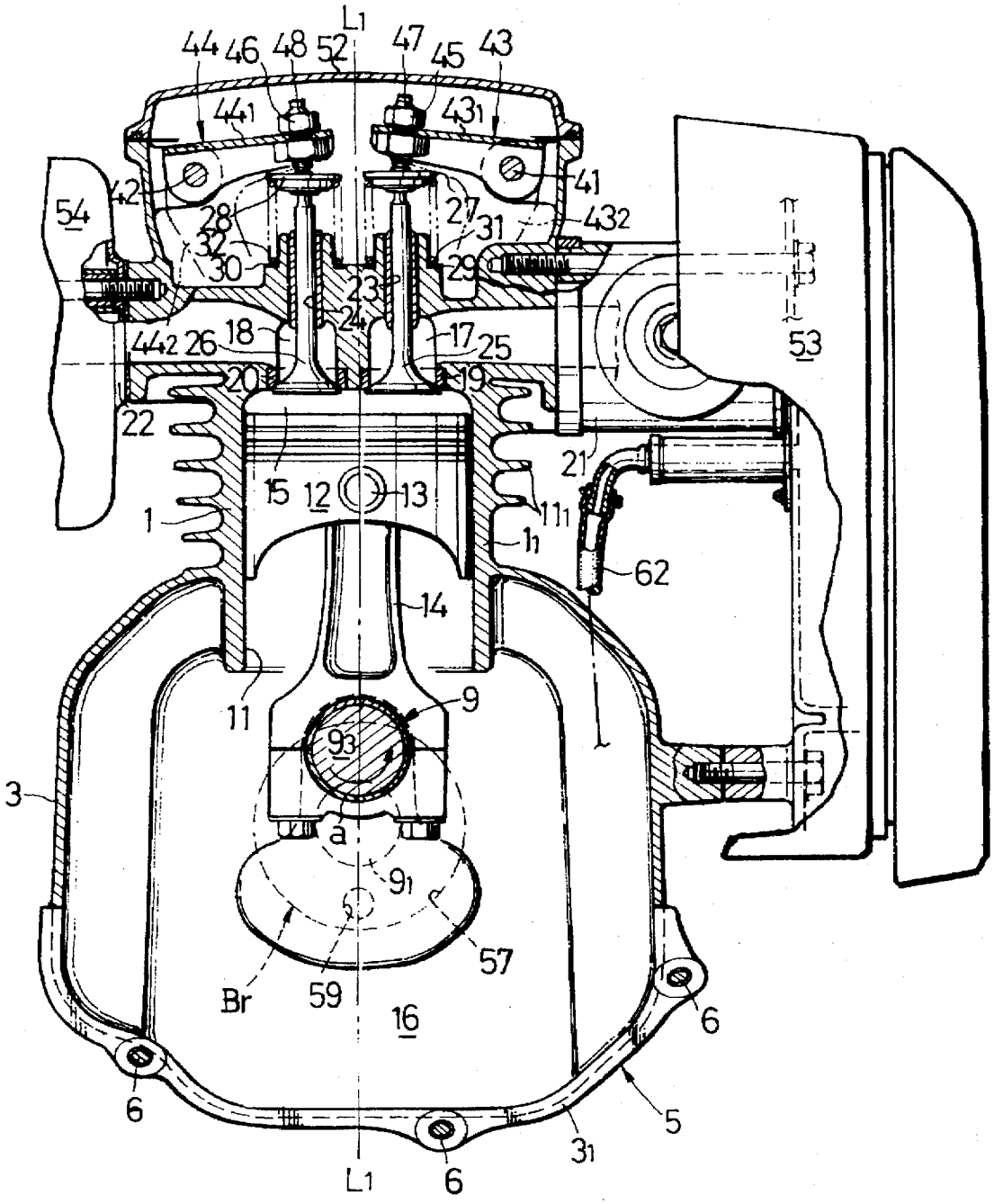
FIG. 3 is a vertical sectional view taken along a line 3—3 in FIG. 1.

As best shown in FIG. 3, an intake port 17 and an exhaust port 18 are defined in the cylinder head 2 on opposite sides of the cylinder axis $L_1$—$L_1$ of the engine body E. Valve seats 19 and 20 are integrally press-fitted into open ends of the ports 17 and 18 in the combustion engine 15, respectively. The intake port 17 extends in one lateral direction within the cylinder head 2, and has an outer end which opens into the outer surface of the cylinder head 2 at one side where it is connected to an intake pipe 21. The exhaust port 18 extends in the other lateral direction within the cylinder head 2 and has an outer end which opens into the outer surface of the cylinder head 2 at the other side where it is connected to an exhaust pipe 22. Valve guide bores 23 and 24 substantially parallel to the cylinder axis $L_1$—$L_1$ are formed in the cylinder head 2, with the cylinder axis $L_1$—$L_1$ interposed therebetween. A stem of an intake valve 25 capable of opening and closing the intake port 17, is slidably inserted through one of the valve guide bores 23, and a stem of an exhaust valve 26 capable of opening and closing the exhaust port 18, is slidably inserted through the other valve guide bore 24. The stems of the intake and exhaust valves 25 and 26 lie in the plane of the axial projection of a valve operating cam 36. Valve springs 31 and 32 comprising coil springs, are mounted under compression between spring seats 29 and 30 engaging the upper ends of the stems of the intake and exhaust valves 25 and 26 and spring seating faces 29 and 30 of the cylinder head 2 are formed on upper surface of the intake and exhaust ports 17 and 18. The valve springs 31 and 32 bias the intake and exhaust valves 25 and 26 in the closing direction, thereby causing valve members of the valves 25 and 26 to be seated in the valve seats 19 and 20. A spark plug 34 is threadedly fitted into an upper wall of the combustion chamber 15 on one side of the intake and exhaust valves 25 and 26 (see FIG. 1).

As shown in FIG. 1, a cam shaft 35 is laid in the cylinder head 2 in parallel to the crankshaft 9 on the cylinder axis $L_1$—$L_1$, and a single valve operating cam 36 is rotatably carried on the cam shaft 35. The center C of the cam shaft 35 is located on or intersects the cylinder axis $L_1$—$L_1$. A timing follower cog pulley 37 is integrally formed on the valve operating cam 36. A timing driving pulley 38 is fitted over and secured to the crankshaft 9 in correspondence to the timing follower pulley 37, and an endless timing cog belt 39 is reeved over the cog pulleys 37 and 38. A timing transmitting mechanism T is formed by the pulleys 37 and 38 and the cog belt 39, so that the rotation of the crankshaft 9 causes the valve operating cam 36 to be rotated through the timing transmitting mechanism T at a rotational ratio of ½ relative to the timing transmitting mechanism T.

The valve operating cam 36 and the cam shaft 35 may be formed integrally with each other and in this case, the cam shaft 35 is rotatably carried in the cylinder head 2.

A driving gear 40 is integrally formed on the timing driving cog pulley 38, and is adapted to drive attachments such as a governor.

Figure 4:
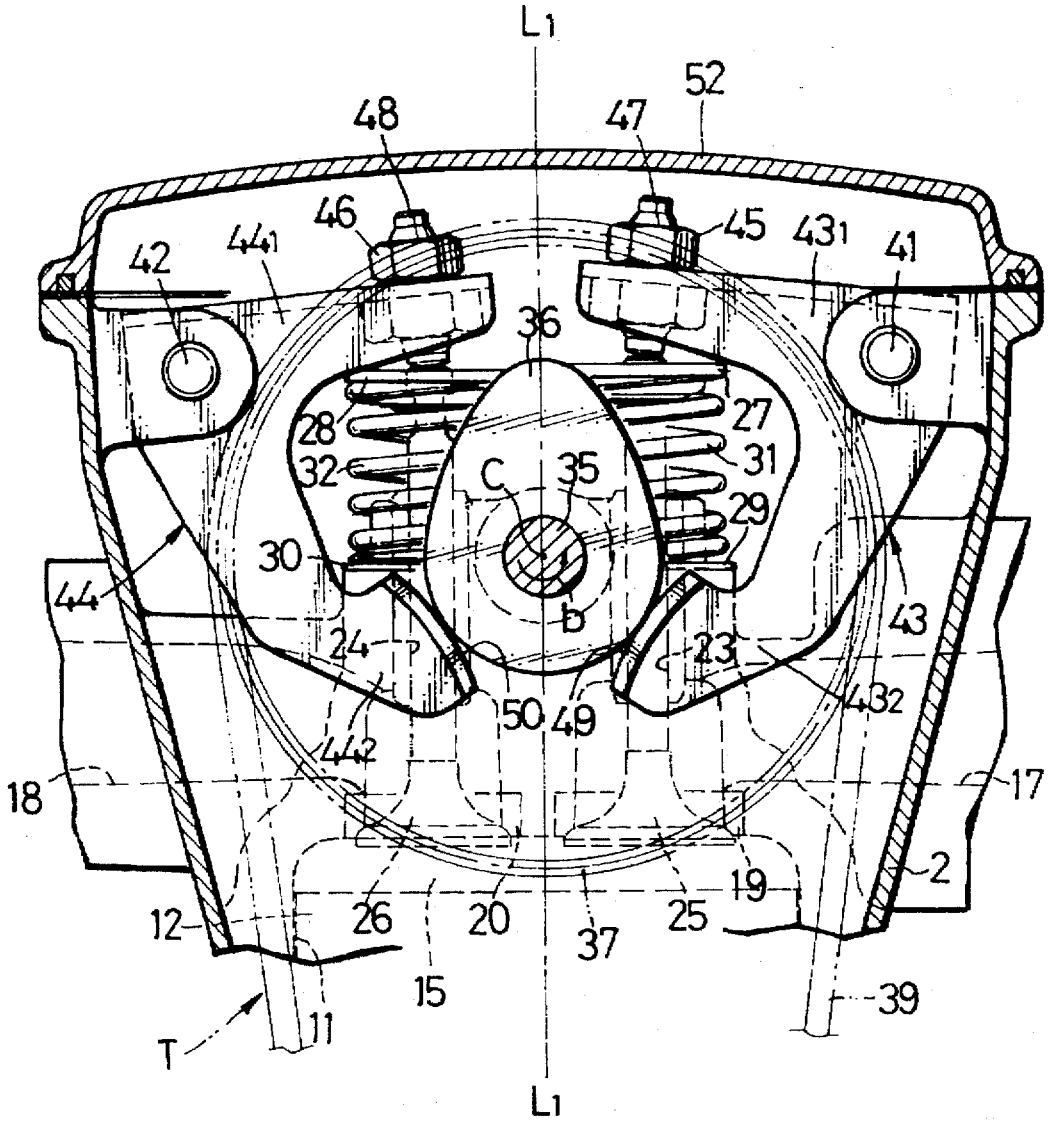
FIG. 4 is an enlarged sectional view taken along a line 4—4 in FIG. 1.

As best shown in FIG. 4, cam follower shafts 41 and 42 are supported symmetrically in the cylinder head 2 above and on opposite sides of the single cam shaft 35. Intake and exhaust cam followers 43 and 44 are rotatably supported at their intermediate portions on the cam follower shafts 41 and 42, respectively. The intake and exhaust cam followers 43 and 44 are disposed symmetrically on opposite sides of the valve operating cam 36 and formed into substantially the same bifurcated shape. The intake and exhaust cam followers 43 and 44 include arm portions $43_1$ and $44_1$ extending substantially horizontally in directions towards each other and towards upper ends of the intake and exhaust valves 25 and 26, and other arm portions $43_2$ and $44_2$ extending downwardly and laterally in directions towards each other and towards a lower portion of the valve operating cam 36, respectively. Adjusting screws 47 and 48 having lock nuts 45 and 46 threadedly fitted thereover, are threadedly inserted into tip ends of the first arm portions $43_1$ and $44_1$, respectively, and have lower ends which are in pressure contact with upper ends of the intake and exhaust valves 25 and 26 resulting from resilient forces of valve springs 31 and 32, respectively. Slip faces or surfaces 49 and 50 are formed on the ends of the other arm portions $43_2$ and $44_2$, respectively, and are in upwardly and laterally turned positions in pressure contact with a cam face or surfaces of the valve operating cam 36 below a center C of rotation of the valve operating cam 36.

The slip faces 49 and 50 may be formed integrally with the other arm portions $43_2$ and $44_2$, or may be formed separately from the other arm portions $43_2$ and $44_2$ and bonded integrally with the other arm portions $43_2$ and $44_2$.

A head cover 52 is mounted on an opened upper surface of the cylinder head 2. An air cleaner 53 is connected to an outer end of the intake pipe 21, and an exhaust chamber 54 is connected to an outer end of the exhaust pipe 22.

The crankcase half 3 of the engine body E is provided with a breather device Br for circulating a blow-by gas within the crankcase 5 into the air cleaner 53 in an intake system.

Figure 2:
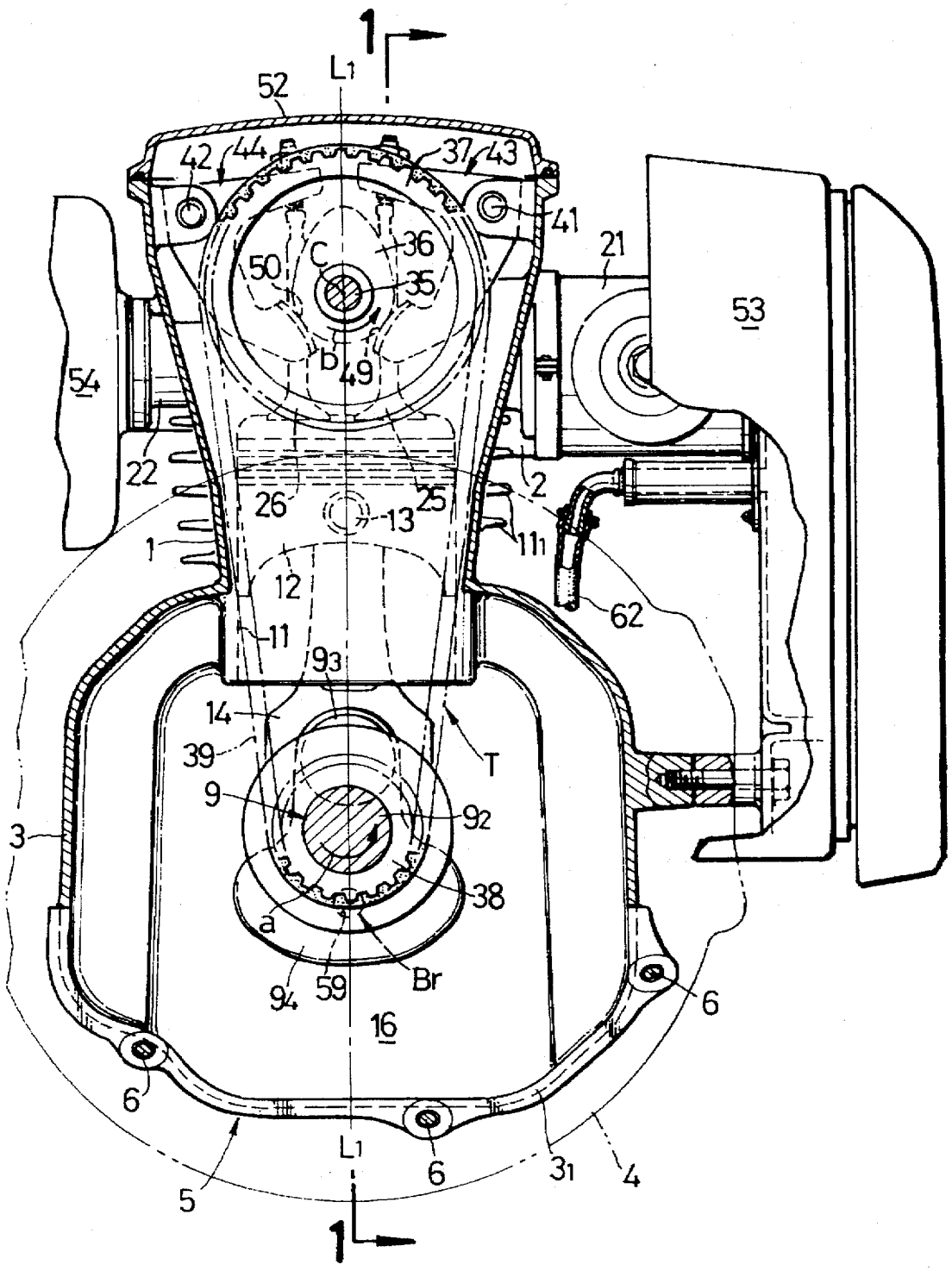
FIG. 2 is a vertical sectional side view taken along a line 2—2 in FIG. 1.
Figure 5:
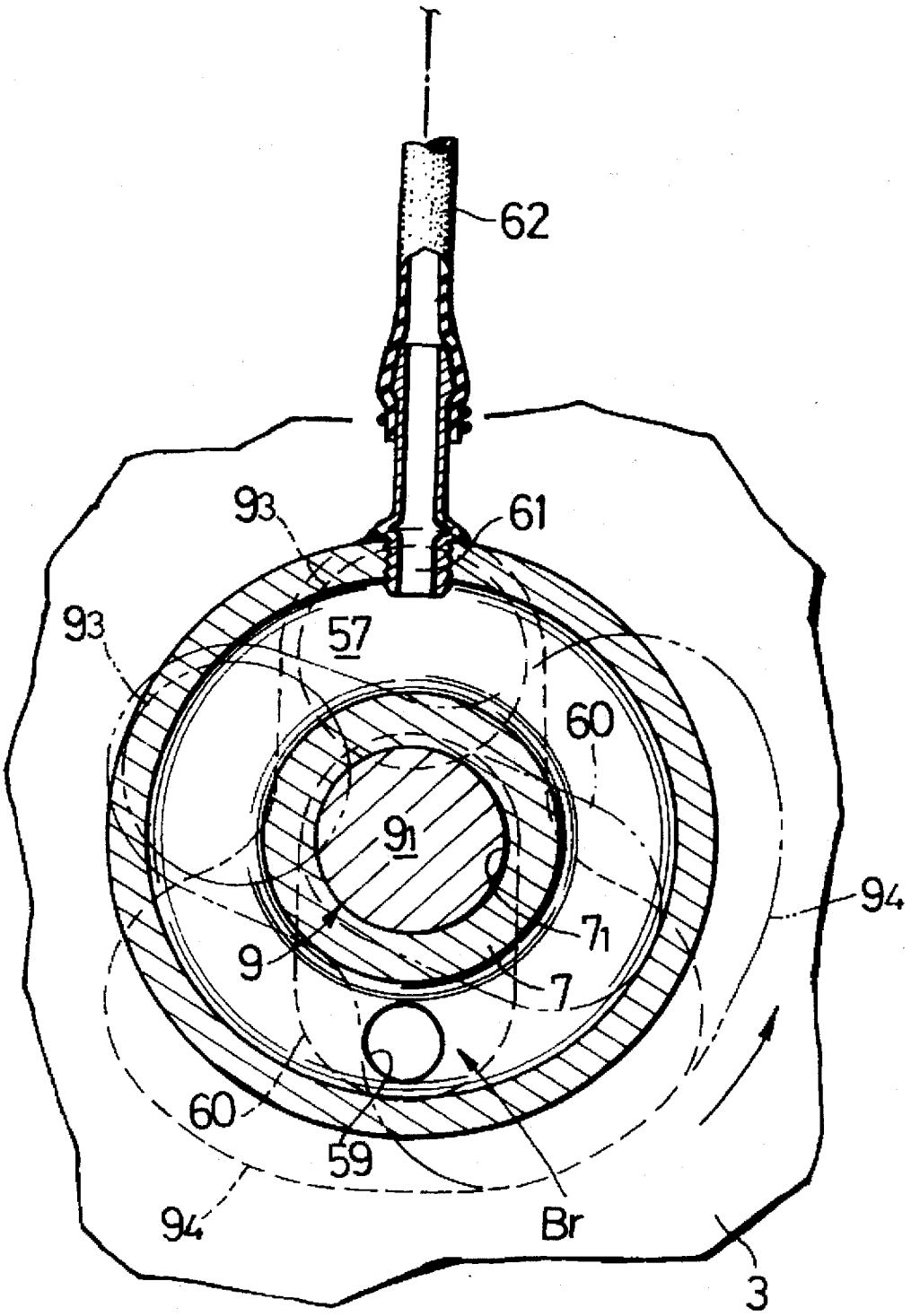
FIG. 5 is a sectional view taken along a line 5—5 in FIG. 1.

The structure of the breather device Br will be described below. Referring to FIGS. 1 and 5, in the crankcase half 3, a breather chamber 57 is defined around an outer periphery of the bearing portion 7 of the crankshaft 9 and has an open end which is sealed by an oil seal 58 provided at the end of the crankshaft 9. Below the crankshaft 9, a communication hole 59 for permitting the breather chamber 57 to communicate with the crank chamber 16, opens into a wall surface partitioning the crank chamber 16 and the breather chamber 57 from each other. A breather valve 60 capable of opening and closing the communication hole 50, is integrally provided and projects from the outer end face of a crank web portion $9_4$ of the crankshaft 9 which confronts the communication hole 59. Thus, as shown in FIGS. 1 to 3, when the piston 12 is located at the top dead center, the communication hole 59 is closed by the breather valve 60, and when the piston 12 is lowered to reach near a bottom dead center, the communication hole 59 is opened into the crank chamber 16. A breather outlet 61 opens into an outer peripheral wall of the breather chamber 57 for opening the breather chamber 57 to the open air, and communicates with the air cleaner 53 in the intake system through a breather pipe 62. The operation of the embodiment will be described below.

When the crankshaft 9 is rotated in a direction of arrow a in FIGS. 1 and 2 by the starting of the engine, the single valve operating cam 36 is rotated in a direction of arrow b in FIGS. 2 and 4 at a reduction ratio of ½ through the timing transmitting mechanism T. The intake and exhaust cam followers 43 and 44 which contact the cam face of the valve operating cam 36 are swung with predetermined timings, whereby the intake and exhaust valves 25 and 26 are opened and closed with predetermined timings in cooperation with the valve springs 31 and 32 to produce the operation of the engine.

In this OHC engine, as described above, the intake and exhaust valves 25 and 26 are disposed parallel to each other on the opposite sides of the single valve operating cam 36 disposed on the cylinder axis $L_1$—$L_1$, so that they intersect the axis $L_2$—$L_2$ of the crankshaft 9 substantially at right angles, and they are partially laid within the plane of axial projection of the single valve operating cam. Moreover, the intake and exhaust cam followers 43 and 44 are formed in a bifurcated shape and swingably supported at their intermediate portions on the cylinder head 2. The one arm portions $43_1$ and $44_1$ of the intake and exhaust cam followers 43 and 44 extend in the directions towards each other and contact the intake and exhaust valves 25 and 26. The other arm portions $43_2$ and $44_2$ also extend in the directions towards each other, so that the slip faces 49 and 50 at their tip ends, contact the cam face of the valve operating cam 36 below the center C of the rotation of the valve operating cam 36. Thus, the intake and exhaust valves and the intake and exhaust cam followers can be collectively disposed in a compact manner to surround the single valve operating cam 36, with no portions projecting outwardly, and the valve operating cam 36 is disposed on the cylinder head 2. In an OHC engine of the type described, the width of the head of the engine, particularly in a direction perpendicular to the crankshaft 9 can be reduced.

In addition, by the fact that the single valve operating cam 36 is disposed in the clearance between the intake and exhaust valves 25 and 26 and the timing follower cog pulley 37, the width of the engine head, particularly in a direction of the crankshaft axis $L_2$—$L_2$ can also be substantially reduced.

When the piston 12 is moved near the bottom dead center by the operation of the engine, the communication hole 59 in the breather device Br is opened, so that the blow-by gas stored in the crank chamber 16 is compressed by the lowering movement of the piston 12 to flow into the breather chamber 57, and is then circulated from the breather chamber 57 through the breather pipe 62 into the air cleaner 53. Lubricating oil mists flowing from the crank chamber 15 into the breather chamber 57 along with the blow-by gas can lubricate the bearing surface of the bearing portion 7 of the crankshaft 9 and the oil seal 58.

When the piston 12 reaches top dead center, the communication hole 59 is closed by the breather valve 60 formed integrally with the crank web portion $9_4$ as shown in FIGS. 1 and 2. Therefore, even if the inside of the crank chamber 16 tends to be depressurized to a negative pressure by the rising movement of the piston, the blow-by gas flowing into the breather chamber 57 cannot flow back into the crank chamber 16.

The present invention is applied to the air cooled single-cylinder type engine in the above-described embodiment, but is of course applicable to any of air cooled multi-cylinder type and water cooled single- and multi-cylinder type engines. In addition, although the cylinder block and the cylinder head are integrally formed in the above-described embodiment, they may be formed separately.

Although the embodiment of the present invention has been described, it will be understood that the present invention is not limited to this embodiment, and various modifications and variations may be made without departing from the spirit and scope of the invention defined in the claims.

I claim:

1. An overhead cam (OHC) engine comprising:

(a) a cylinder block;

(b) a cylinder head mounted on said cylinder block;

(c) a crankshaft for reciprocating a piston in a cylinder in said cylinder block;

(d) a cam shaft mounted in said cylinder head;

(e) a valve operating cam mounted on said cam shaft and rotatably therewith;

(f) at least one intake and at least one exhaust valve mounted in said cylinder head;

(g) at least one intake and at least one exhaust cam follower operatively coupling said intake valve and said exhaust valve respectively to said valve operating cam; wherein (h) the center axis of said cam shaft intersects the axis of said cylinder;

(i) said intake and exhaust valves are positioned parallel to each other symmetrically disposed on opposite sides of said cam shaft axis, and perpendicular thereto; and (j) said intake and exhaust cam followers are symmetrically disposed on opposite sides of said cam shaft axis, wherein said intake and exhaust cam followers each have two arm portions, one arm portion of each said intake and exhaust cam followers extending towards each other and contacting said intake and exhaust valve respectively, and the other arm portions of said intake and exhaust cam followers respectively extending towards each other, said other arm portions contacting the cam surface of said valve operating cam.

2. An OHC engine as set forth in claim 1, wherein said intake and exhaust cam followers each include an intermediate portion between said one end portion and said other end portion, said intermediate portion being pivotally mounted on said cylinder head.

3. An OHC engine as set forth in claim 1, wherein said other arm portions of said intake and exhaust cam followers each include slip surfaces at the tips thereof, said slip surfaces contacting the cam surface of said valve operating cam below the center of rotation thereof.

4. An OHC engine as set forth in claim 1, including timing means for coupling said cam shaft to said crankshaft such that the rotation of said crankshaft rotates said cam shaft.

5. An OHC engine as set forth in claim 4, wherein said timing means includes a timing follower pulley and wherein said valve operating cam is positioned in said cylinder head in a space between said intake valve, said exhaust valve and said timing follower pulley.

6. An OHC engine as set forth in claim 1, including a breather means for circulating blow-by gas through said engine.

* * * * *